United States Patent [19]

Hill

[11] 4,031,403

[45] June 21, 1977

[54] ROAD VEHICLE ELECTRICAL SYSTEMS

[75] Inventor: William Frank Hill, Stafford, England

[73] Assignee: The Lucas Electrical Company Limited, Birmingham, England

[22] Filed: Sept. 22, 1975

[21] Appl. No.: 615,806

Related U.S. Application Data

[63] Continuation of Ser. No. 385,561, Aug. 3, 1973.

[52] U.S. Cl. ..... 290/38 R; 290/37 R

[51] Int. Cl.[2] ..... F02N 11/00

[58] Field of Search ..... 290/37 A, 37 R, 37 B, 290/38 R; 123/179

[56] References Cited

UNITED STATES PATENTS 3,783,301 1/1974 Nieukirk ..... 290/37

*Primary Examiner*—Robert K. Schaefer
*Assistant Examiner*—John W. Redman

[57] ABSTRACT

A road vehicle electrical system has an alternator which provides power through a rectifier to a battery, and also supplies a third supply line used for feeding an ignition warning lamp. Control means for the starting system of the vehicle is associated with the supply lines in such a way that once the engine has started and the third supply line is energized, a further attempt cannot be made to start the engine until the engine has stopped.

8 Claims, 2 Drawing Figures

ROAD VEHICLE ELECTRICAL SYSTEMS

This is a continuation of application Ser. No. 385,561, filed Aug. 3, 1973.

This invention relates to road vehicle electrical systems.

A system according to the invention comprises an alternator supplying power through a rectifier to first and second supply lines between which the vehicle battery is connected, one or more additional diodes connecting the alternator to a third supply line which when the alternator is operating will reach substantially the same potential as the first line, a warning lamp connected in series with the vehicle ignition switch between the third and first supply lines, a voltage regulator connected between the third and second supply lines, a starter motor, and a control device which when energised energises the starter motor, the control device which when energised energises the starter motor, the contorl device being connected in a circuit between the first and third supply lines so that the control device can be energised by way of the voltage regulator, but when the alternator energises the third supply line, the control device is de-energised said circuit further including switching means for preventing the control device from being energised again until the engine has stopped.

The control device could be connected between the first and third supply lines in series with the starter switch of the vehicle. However, in one arrangement the control device is connected between the first and third supply lines in series with the ignition switch of the vehicle, the control device serving when it is energised to close a switch connected in series with the starter switch of the vehicle, the starter switch serving when it is closed to energise the motor provided that said switch has been closed by the control device.

The control device is conveniently a relay winding.

Figure 1:
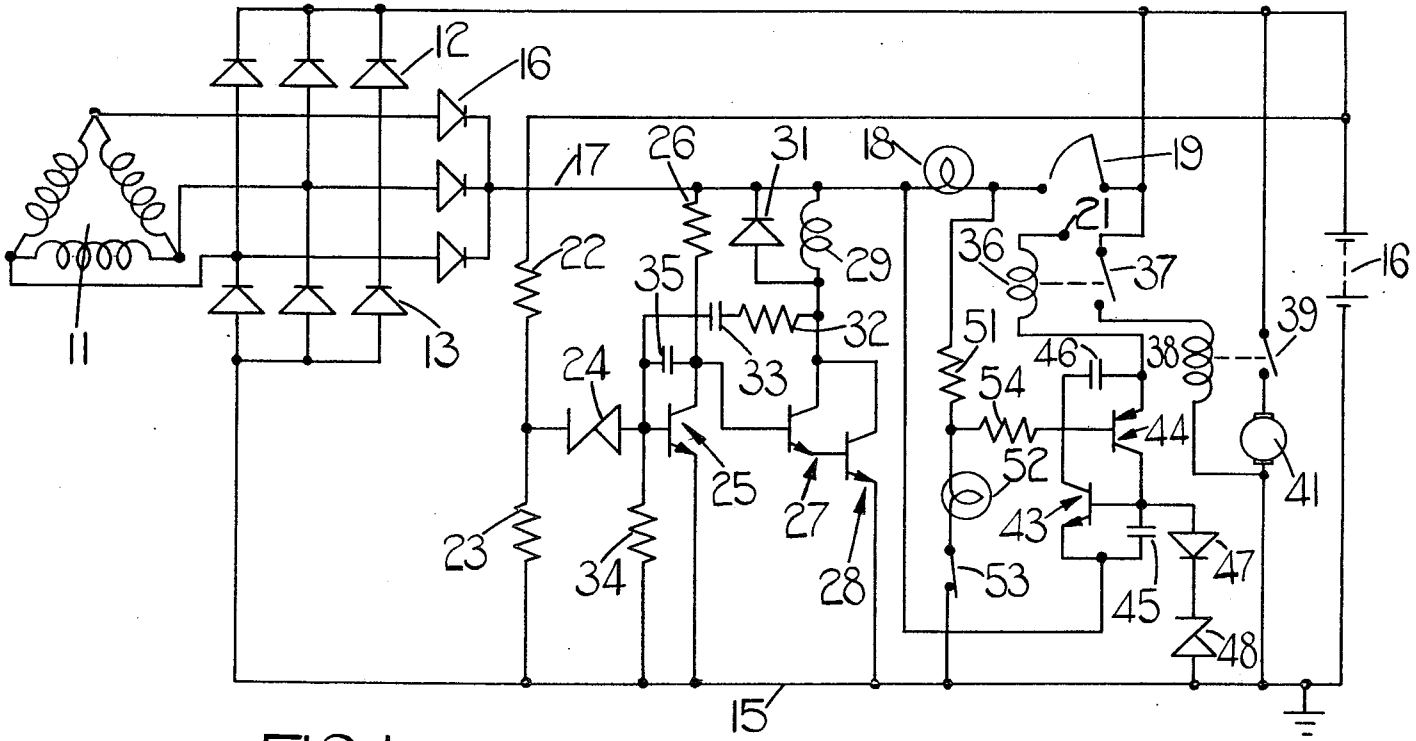
Figure 2:
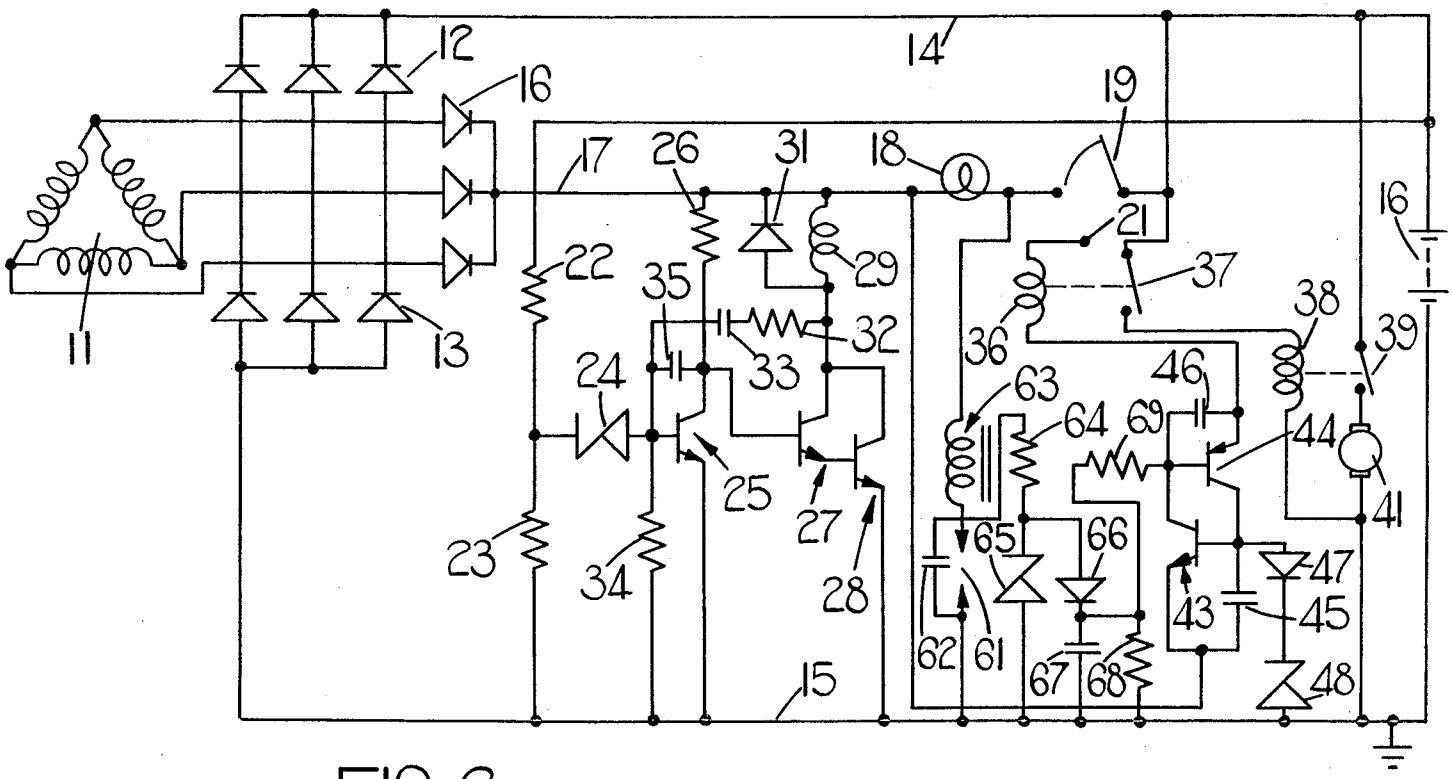

In the accompanying drawings, FIGS. 1 and 2 are circuit diagrams illustrating two examples of the invention.

Referring to FIG. 1, the road vehicle includes an alternator 11 which supplies power through a full wave rectifier including two sets of diodes 12 and 13 to a positive line 14 and a negative line 15 between which the battery 16 of the vehicle is connected. The line 15 is earthed. The alternator 11 also provides power through three additional diodes 16 to a positive supply line 17 which is connected to the line 14 through a warning lamp 13 and a vehicle ignition switch 19 in series. The switch 19 is movable from its off position shown to an ignition position in which it connects the line 14 to the line 17 through the lamp 18, and a starting position in which the switch 19 maintains the supply to the line 17 by way of the lamp 18, but also completes a circuit to a contact 21.

Connected in series between the positive terminal of the battery 16 and the line 15 are a pair of resistors 22, 23, the junction of which is connected through a Zener diode 24 to the base of an n-p-n transistor 25 having its emitter connected to the line 15 and its collector connected through a resistor 26 to the line 17. The collector of the transistor 25 is further connected to the base of an n-p-n transistor 27 having its emitter connected to the base of an n-p-n transistor 28 the emitter of which is connected to the line 15. The collectors of the transistors 27 and 28 are connected through the field winding 29 of the alternator to the line 17, the winding 29 being bridged by a free wheel diode 31. A positive feedback circuit consisting of a resistor 32 and a capacitor 33 in series is connected between the collector of the transistor 27 and the base of the transistor 25, and the transistor 25 also has its base connected to the line 15 through a resistor 34, and its base and collector interconnected through a capacitor 35 which minimises radio interference.

The line 17 is connected to the emitter of an n-p-n transistor 43 having its collector and base connected respectively to the base and collector of a p-n-p transistor 44. The transistor 44 has its emitter connected to the contact 21 through a relay winding 36 which when energised closes a normally open contact 37 which is connected in series with a relay winding 38 between the line 21 and the line 15. The winding 38 serves when energised to close a normally open contact 39 connected in series with the starter motor 41 of the vehicle between the lines 14 and 15. The base-emitter circuits of the transistors 43 and 44 are bridged by capacitors 45 and 46 respectively, and the collector of the transistor 44 is connected through a diode 47 and a Zener diode 48 in series with the line 15. Moreover, the junction of the lamp 18 and the ignition switch 19 is connected to the line 15 through a series circuit including a resistor 51, the oil pressure warning lamp 52 of the vehicle and the oil pressure switch 53 of the vehicle. The junction of the resistor 51 and lamp 52 is connected through a resistor 54 to the base of the transistor 44.

Considering first the operation of the voltage regulator when the switch 19 is open, there is a small current flow through the resistors 22 and 23, but this flow is negligible and so does not discharge the battery 16 to any degree. When the ignition switch 19 is closed, current flows from the battery 16 to illuminate the warning lamp 18 and energise the line 17, and at this stage the Zener diode 24 is non-conductive and current flow through the resistor 26 turns on the transistor 27 and 28 so as to energise the field winding 29.

When the alternator produces an output, the line 17 assumes substantially the same potential as the line 14, and so the warning lamp 18 is extinguished. The winding 29 remains energised by virtue of current flowing through the resistor 26 from the alternator 11 through the diodes 16 and the lines 17. When the battery voltage reaches a predetermined value, the Zener diode 24 conducts to turn on the transitor 25, which removes base current from the transistor 27 and 28. By virtue of the feedback circuit 32, 33, the regulator oscillates between one state with transistors 27, 28 off and transistor 25 on, and another state with transistors 27, 28 on and transistor 25 off. The mean current flow in the winding 29 is determined by the mark space ratio, which is determined by the current flowing through the Zener diode 24. This current is of course dependent on the voltage of the battery 16.

Considering now the starter circuit, when the ignition switch 19 is closed to illuminate the lamp 18, then the lamp 52 is also illuminated because the switch 53 is closed at this stage. The transistors 44 and 43 are both off. Movement of the ignition switch into engagement with the contact 21 causes current to flow through the winding 36, the emitter base of the transistor 44, the lamp 52 and the switch 53 to the line 15 but this current is insufficient to energise the winding 36. Moreover, the collector current of the transistor 44 flows by way of the base emitter of the transistor 43, the line 17 the field winding 29 and the transistors 27 and 28 to turn on the transistor 43, which completes a base circuit for the transistor 44 through the transistor 43, the line 17, the resistor 26 and the transistors 27 and 28. The winding 36 is now energised to close the contact 37, energise the winding 38, close the contact 39 and energise the starter motor 41. Moreover, even though the switch 53 opens, the transistors 43 and 44 are still on, and so if the ignition switch 19 is maintained in engagement with the contact 21 the winding 36 can still remain energised even though the switch 53 opens. However, as soon as the alternator produces an output, the potential on the line 17 becomes substantially equal to the potential of the positive terminal of the battery 16, and so the transistors 43 and 44 turn off and the starter motor 41 is disengaged. Of course, if the ignition switch 19 is returned to its ignition position before the alternator produces an output, then the transistors 43 and 44 will turn off.

If an attempt is made to re-energise the winding 36 while the engine is still operating, then the transistors 44 and 43 cannot be turned on, and so the winding 36 cannot be energised. Even when the potential on the line 17 falls to a value such that the transistors 43 and 44 could conduct, the winding 36 can still not be energised until the switch 53 closes again.

The purpose of the Zener diode 48 is to reduce the potential required on the line 17 to turn off the transistors 43 and 44. The capacitors 45 and 46 and the diode 47 are incorporated to prevent the circuit from being triggered by transients.

Referring now to the example shown in FIG. 2, the circuit is the same as FIG. 1 except for the way in which the base drive is provided for the transistor 44. The circuit will of course still include the components 51, 52 and 53, which are present in the system anyway, but the resistor 54 is not now provided. As seen in FIG. 2, the junction of the lamp 18 and the ignition switch is connected in the usual way to the line 15 through the primary winding 63 of the ignition coil and the vehicle contact breaker 61 in series. The contact breaker 61 is bridged by a capacitor 62 in the usual way. The remaining components are added to the existing system, and include a resistor 64 and a Zener diode 65 connected between the junction of the contact breaker 61 and winding 63 and the line 15. The Zener diode 65 is bridged by a diode 66 and a capacitor 67 in series, and the junction of the diode 66 and capacitor 67 is connected to the line 15 through a resistor 68, and to the base of the transistor 44 through a resistor 69.

When the switch 19 is moved into engagement with the contact 21, initial base drive for the transistor 44 is provided by way of the resistors 69 and 68, and as in FIG. 1 this current is insufficient to energise the winding 36. However, as soon as the transistors 44 and 43 start to conduct, a circuit is completed to the transistors 44 and 43 by way of the line 17, so that the transistors 43 and 44 conduct to energise the winding 36 and so operate the starter motor. When the alternator is producing an output, the potential on the line 17 is substantially equal to the potential at the positive terminal of the battery 16, and so the transistors 43 and 44 turn off and the starter motor 41 is disengaged.

When the engine has started, the potential across the primary winding 63 of the ignition coil causes charging of the capacitor 67 by way of the diode 66 to a potential in excess of battery voltage. Thus, if an attempt is made to energise the starter motor 41 again, the transistors 43 and 44 will be held off by the capacitor 67 even if the potential on the line 17 falls for any reason. When the engine stops, the transistors 43 and 44 will still be held off for a predetermined period of time during which the capacitor 67 discharges through the resistor 68.

During cranking, the capacitor 67 is charged to a potential in excess of battery voltage, but the transistors 43 and 44 are not turned off because re-generative current from the collector of the transistor 43 sustains base drive to the transistor 44.

In a modification of either example, the winding 36 is returned to the junction of the lamp 18 and ignition switch 19, instead of to the contact 21. In this arrangement, the contact 37 connects the winding 38 to the contact 21, not to the line 14. The operation is basically unaffected.

In some cases, it may be advisable to connect a free wheel diode across the winding 36.

I claim:

1. A road vehicle electrical system comprising an alternator, first and second supply lines, a rectifier connecting the alternator to the first and second supply lines, a vehicle battery connected between the first and second supply lines, at least one additional diode connecting the alternator to a third supply line which when the alternator is operating will reach substantially the same potential as the first line, a warning lamp connected in series with the vehicle ignition switch between the the third and first supply lines, a voltage regulator connected between the third and second supply lines, a starter motor, a control device for the starter motor which when energised energises the starter motor, circuit means connecting said control device between the first and third supply lines so that the control device is energised by way of the voltage regulator, but is de-energised when the alternator energises the third supply line, and switching means operated by the engine of the vehicle independently of the alternator for preventing the control device from being re-energised while the engine is running.

2. The system as claimed in claim 1 in which said circuit means connects the control device between the first and third supply lines in series with the starter switch of the vehicle.

3. The system as claimed in claim 1 in which said circuit means connects the control device between the first and third supply lines in series with the ignition switch of the vehicle, the control device serving when it is energised to close a switch connected in series with the starter switch of the vehicle, the starter switch serving when it is closed to energise the motor provided that said switch has been closed by the control device.

4. The system as claimed in claim 1 in which the control device is a relay winding.

5. The system as claimed in claim 1, wherein: said circuit means including a transistor having its collector and emitter connected in a current loop between said control device and said third supply line; said switching means including an oil pressure switch connected between said second and said third supply lines, with a biasing connection to the base of said transistor; said oil pressure switch changing conductive states in response to the oil pressure in the propulsion motor of said vehicle reaching an operating pressure; said pressure switch biasing said transistor off when said oil pressure is greater than a threshold value.

6. The system of claim 5, wherein said circuit means operates with a self-contained switching action.

7. The system as claimed in claim 1, wherein: a road vehicle electrical system comprising an alternator supplying power through a rectifier to first and second supply lines between which the vehicle battery is connected, one or more additional diodes connecting the alternator to a third supply line which when the alternator is operating will reach substantially the same potential as the first line, a warning lamp connected in series with the vehicle ignition switch between the third and first supply lines, a voltage regulator connected between the third and second supply lines, a starter motor, and a control device which when energised energises the starter motor, circuit means connecting said control device between the first and third supply lines so that the control device is energised by way of the voltage regulator, but is de-energised when the alternator energises the third supply line, said circuit means further including switching means for preventing the control device from being energised again until the engine has stopped; said circuit means including a transistor having its collector and emitter connected in a current loop between said control device and said third supply line; said switching means including an ignition primary coil breaker switch connected in series at a node between said second and said third supply lines, with a biasing connection between said node and the base of said transistor; said breaker switch changing conductive states in response to the operation of the propulsion motor of said vehicle; said biasing connection including a capacitor and resistor connected between said node and said second supply line; said breaker switch imparting a biasing potential on said capacitor during the operation of said propulsion motor, which biases said transistor off.

8. The system of claim 7, wherein said circuit means operates with a self-contained switching action.

* * * * *